US006452343B2

(12) United States Patent
Oostvogels et al.

(10) Patent No.: US 6,452,343 B2
(45) **Date of Patent: *Sep. 17, 2002**

(54) BALLAST CIRCUIT

(75) Inventors: Ludovicus F. J. Oostvogels, Eindhoven (NL); Lucas Vos, Hanover Park, IL (US); Angelo V. Gavas, Arlington Heights, IL (US); Enrique Sotelo Gallardo, Monterrey NL (MX)

(73) Assignee: Koninklijke Philips Electronics N.V., Eindhoven (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/543,335

(22) Filed: Apr. 5, 2000

Related U.S. Application Data

(63) Continuation-in-part of application No. 09/441,945, filed on Nov. 17, 1999.

(51) Int. Cl.[7] ..... H05B 37/02

(52) U.S. Cl. ..... 315/209 R; 315/272; 315/291; 315/DIG. 4; 315/DIG. 7

(58) Field of Search ..... 315/209 R, 209 T, 315/268, 272, 291, 307, 362, DIG. 2, DIG. 4, DIG. 5, DIG. 7

(56) References Cited

U.S. PATENT DOCUMENTS

| | | | | | |
|---|---|---|---|---|---|
| 4,356,433 | A | * | 10/1982 | Linden | 315/DIG. 7 |
| 5,194,782 | A | * | 3/1993 | Richardson et al. | 315/291 |
| 5,410,221 | A | * | 4/1995 | Mattas et al. | 315/307 |
| 5,416,387 | A | * | 5/1995 | Cuk et al. | 315/209 R |
| 5,608,292 | A | * | 3/1997 | Konopka et al. | 315/209 R |
| 5,770,925 | A | * | 6/1998 | Konopka et al. | 315/307 |
| 5,856,728 | A | * | 1/1999 | Zimnicki et al. | 315/209 R |
| 5,936,357 | A | * | 8/1999 | Crouse et al. | 315/DIG. 7 |
| 5,982,110 | A | * | 11/1999 | Gradzki | 315/291 |
| 5,982,159 | A | * | 11/1999 | Janczak et al. | 315/247 |
| 6,034,489 | A | * | 3/2000 | weng | 315/307 |
| 6,051,938 | A | * | 4/2000 | Arts et al. | 315/291 |
| 6,157,142 | A | * | 12/2000 | Moisin | 315/307 |

FOREIGN PATENT DOCUMENTS

| | | | |
|---|---|---|---|
| EP | 0338109 A1 | 10/1989 | H05B/41/29 |
| WO | WO9512300 | 5/1995 | H05B/41/29 |
| WO | WO9743878 | 11/1997 | H05B/41/29 |
| WO | WO9846053 | 10/1998 | H05B/41/36 |
| WO | WO9846054 | 10/1998 | H05B/41/36 |
| WO | WO9917591 | 4/1999 | H05B/41/29 |

* cited by examiner

*Primary Examiner*—Don Wong

(57) ABSTRACT

In a TRIAC dimmable ballast for a discharge lamp comprising a buffer capacitor and a control circuit, a shut off circuit is incorporated for switching off the control circuit when the voltage over the buffer capacitor drops below a predetermined value due to a high phase angle adjusted in the TRIAC dimmer.

18 Claims, 2 Drawing Sheets

BALLAST CIRCUIT

This application is a C-I-P of Ser.No. 09/441,945 filed Nov. 17, 1999.

BACKGROUND OF THE INVENTION

The invention relates to a ballast circuit for operating a discharge lamp comprising input terminals for connection to a supply voltage source, a rectifier coupled to the input terminals for rectifying a low frequency supply voltage supplied by the supply voltage source, a buffer capacitor circuit coupled to an output of the rectifier, an inverter coupled to the buffer capacitor circuit for generating a high frequency lamp current out of a DC voltage that is present over the buffer capacitor circut during operation, said inverter comprising a control circuit for controlling the operation of the inverter.

Such a ballast circuit is known from WO 98/46054.The known ballast circuit is equipped with a dimming circuit for controlling the light output of the discharge lamp in dependency of a dimming signal and with a conversion circuit for converting the shape of the low frequency supply voltage present between the input terminals into a dimming signal. The shape of the low frequency supply voltage in turn depends on the phase angle of a TRIAC dimmer that is used in combination with the known ballast circuit. Thanks to the presence of the dimming circuit and the conversion circuit, the ballast circuit is TRIAC dimmable. When the phase angle of the TRIAC dimmer is changed, the shape of the low frequency supply voltage changes accordingly so that the dimming signal generated by the conversion circuit and therefore the light output of the discharge lamp change as well. Up to a phase angle of 90 degrees the DC voltage that is present over the buffer capacitor means remains substantially unchanged. For phase angles higher than 90 degrees, however, the DC voltage that is present over the buffer capacitor means decreases when the phase angle is increased. When the voltage over the buffer capacitor means drops too much the control circuit will receive insufficient energy to operate properly and as a result of that the discharge lamp will extinguish. After the discharge lamp has extinguished the power consumption of the ballast circuit is much lower so that the DC voltage over the buffer capacitor means will increase. After a certain amount of increase of the DC voltage the control circuit is activated again and will ignite the discharge lamp. Once the discharge lamp has ignited the power consumption of the ballast circuit is increased so much that the DC voltage over the buffer capacitor means drops once more resulting in an almost immediate extinguishing of the discharge lamp. The cycle of events described hereabove repeats itself time after time resulting in flickering of the discharge lamp. Besides the fact that this is unpleasant to look at, the electrodes will be damaged since the lamp ignites without the electrodes having been preheated in a proper way.

BRIEF SUMMARY OF THE INVENTION

The invention aims to provide a ballast circuit that is TRIAC dimmable but does not have the disadvantages mentioned hereabove.

A ballast circuit as mentioned in the opening paragraph is therefor according to the invention characterized in that the ballast circuit comprises a shut off circuit for switching off the control circuit if the DC voltage over the buffer capacitor circuit (hereinafter referred to simply as buffer capacitor drops below a first predetermined value.

If a ballast circuit according to the invention is used in combination with a TRIAC dimmer and a user chooses a phase angle that is too high, the DC voltage over the buffer capacitor means drops below the first predetermined value and the shut off circuit switches the control circuit off so that the discharge lamp extinguishes and flickering of the discharge lamp is prevented.

It is for instance possible to implement the shut off circuit in such a way that it is equipped with a reactivation switch for the user of the ballast circuit. In that case the control circuit remains switched off until a user of the ballast circuit has used the reactivation switch. Such a reactivation switch could be implemented as the mains switch for electrically connecting the ballast circuit to the supply voltage source. However, unless the phase angle of the TRIAC dimmer has been adjusted to a lower value, after reactivation the control circuit will be switched off again virtually immediately after the discharge lamp has ignited. As a result, in case a user of the ballast circuit chooses a value of the phase angle that results in the switching off of the control circuit, that user will have to use both the TRIAC dimmer and the reactivation switch to reactivate the ballast circuit. Since this is a strong disadvantage the shut off circuit preferably comprises a hysteresis circuit for reactivating the control circuit after the first shut off of the control circuit if the DC voltage over the buffer capacitor means rises above a second predetermined value that is higher than the first predetermined value, and switching off the control circuit when the DC voltage over the buffer capacitor drops below the second predetermined value.

When the shut off circuit has switched off the control circuit and the discharge lamp has extinguished, the ballast circuit no longer consumes any power or consumes only a relatively small amount of power. This results in an increase of the DC voltage that is present over the buffer capacitor. Because the second predetermined value is higher than the first predetermined value this increase does not result in an immediate reactivation of the control circuit. The control circuit is only reactivated when the DC voltage over the buffer capacitor has increased substantially. It is to be noted that the second predetermined value must not be chosen too high, since that would prevent the reactivation circuit from reactivating the control circuit even if a user decreases the phase angle of the TRIAC dimmer to a value that allows stable lamp operation, after the control circuit has been shut off.

If the ballast circuit does not consume any power after the shut off circuit has switched off the control circuit, the TRIAC dimmer carries no load current after the shut off of the control circuit. In practice it has been found that often under these circumstances the TRIAC dimmer fires at random. As a consequence the voltage over the buffer capacitor means reaches its maximum value and the control circuit is reactivated. However, as soon as the discharge lamp has ignited, a load current is once more present so that the TRIAC dimmer fires at the adjusted phase angle and the voltage over the buffer capacitor means drop below the first predetermined value so that the control circuit is switched off and the discharge lamp extinguishes. After the extinguishing of the discharge lamp the TRIAC dimmer once more fires at random etc. so that flickering of the discharge lamp results. This flickering can be prevented by assuring that there is a load current present even when the control circuit has been switched off. This can be realized in an effective manner by connecting the input terminals by means of a circuit part that carries a current as long as the low frequency supply voltage has an amplitude that differs from zero. Preferably the circuit part comprises an ohmic resistor.

In case the control circuit is reactivated after having been shut off, it will generally first control the operation of the inverter in such a way that the electrodes of the discharge lamp are preheated. The power consumption of the ballast circuit is relatively low during preheating when compared with the power consumption during ignition and during normal or dimmed operation. In spite of the fact that the power consumption is relatively low, the second predetermined value is chosen so that this power consumption will cause the DC voltage over the buffer capacitor to drop below the second predetermined value while the ballast circuit is still preheating the electrodes of the discharge lamp. As a result the control circuit is once more switched off before the discharge lamp has ignited and therefor flickering is prevented. After the control circuit has been switched off, the ballast circuit no longer supplies a preheat current to the electrodes of the discharge lamp so that the DC voltage over the buffer capacitor once more increases to the second predetermined value so that the reactivation circuit reactivates the control circuit and the electrodes of the discharge lamp are heated until the control circuit is switched off again. In case, however, a user of the ballast circuit lowers the phase angle of the TRIAC dimmer to a sufficient extent, the DC voltage over the buffer capacitor will increase to a higher value and will not drop below the second predetermined value during the preheat of the electrodes. In that case the discharge lamp may be ignited once more and burn steadily after ignition. Since the power consumption of the ballast circuit will generally increase during ignition and normal or dimmed operation, it is desirable to deactivate the hysteresis circuit after the preheating of the electrodes. In other words, in case the control circuit successively controls the operation of the ballast circuit to preheat electrodes of the discharge lamp, to ignite the discharge lamp and to operate the discharge lamp, the shut off circuit preferably comprises a deactivation circuit for deactivating the hysteresis circuit after the preheating of the electrodes of the discharge lamp.

The continuous repetition of electrode heating that takes place in a ballast circuit according to the invention, in which the shut off circuit is equipped with a hysteresis circuit, causes such a high temperature of the electrodes that they are damaged as a result of this temperature. To prevent such damage the shut off circuit preferably comprises a delay circuit for delaying the reactivation of the control circuit after the DC voltage over the buffer capacitor means has reached the second predetermined value. Since the control circuit is only reactivated after a delay, the electrodes of the discharge lamp can cool down longer before another preheat cycle starts so that the average temperature of the electrodes is lower. The delay means can be implemented in a relatively simple and cheap way by making use of a resistor, a capacitor and a diode or a zener diode.

In practice the control circuit of an electronic ballast circuit often comprises an integrated circuit. In that case the electronic ballast further includes a supply circuit part coupled with the control circuit for generating a DC supply voltage for the control circuit. Such an integrated circuit is often equipped with a switch off circuit part for switching off the control circuit in case the DC supply voltage drops below a predetermined lock out voltage. In case such a switch off circuit is comprised in the control circuit, the shut off circuit can be realized in a relatively simple way in case the shut off circuit part comprises means for clamping the DC supply voltage to a fraction of the DC voltage that is present over the buffer capacitor means. A proper choice of the fraction will make sure that when the DC voltage over the buffer capacitor means drops below the first predetermined value, the DC supply voltage of the control circuit drops below the predetermined lock out voltage so that the switch off circuit switches the control circuit off. It has been found that this clamping could be realized in an efficient and simple way making use of a bipolar transistor.

In a ballast circuit in which the DC supply voltage is clamped to a fraction of the DC voltage over the buffer capacitor means, the hysteresis circuit can relatively easily be realized in case the shut off circuit comprises a fraction decrease circuit part for decreasing the fraction of the DC voltage after shut off of the control circuit, over the buffer capacitor means that the DC supply voltage is clamped to. Since the fraction is decreased, the DC voltage over the buffer capacitor means will have to increase to a higher value (the second predetermined value) before the DC supply voltage reaches the predetermined lock out voltage and the control circuit is reactivated. It has been found that the fraction decrease circuit can be realized in a relatively simple way, in case use is made of a transistor.

Since TRIAC dimmers are normally used in combination with incandescent lamps, the ballast circuit according to the present invention is particularly suitable to be used in a compact fluorescent lamp, since compact fluorescent lamps are often used to replace incandescent lamps and are equipped with the same lamp sockets as incandescent lamps.

BRIEF DESCRIPTION OF THE SEVERAL VIEWS OF THE DRAWINGS

Embodiments of a ballast circuit according to the invention will be discussed with reference to a drawing.

In the drawing FIGS. 1–4 each show an embodiment of a ballast circuit according to the invention with a discharge lamp connected to the ballast circuit.

DETAILED DESCRIPTION OF THE INVENTION

Figure 1:
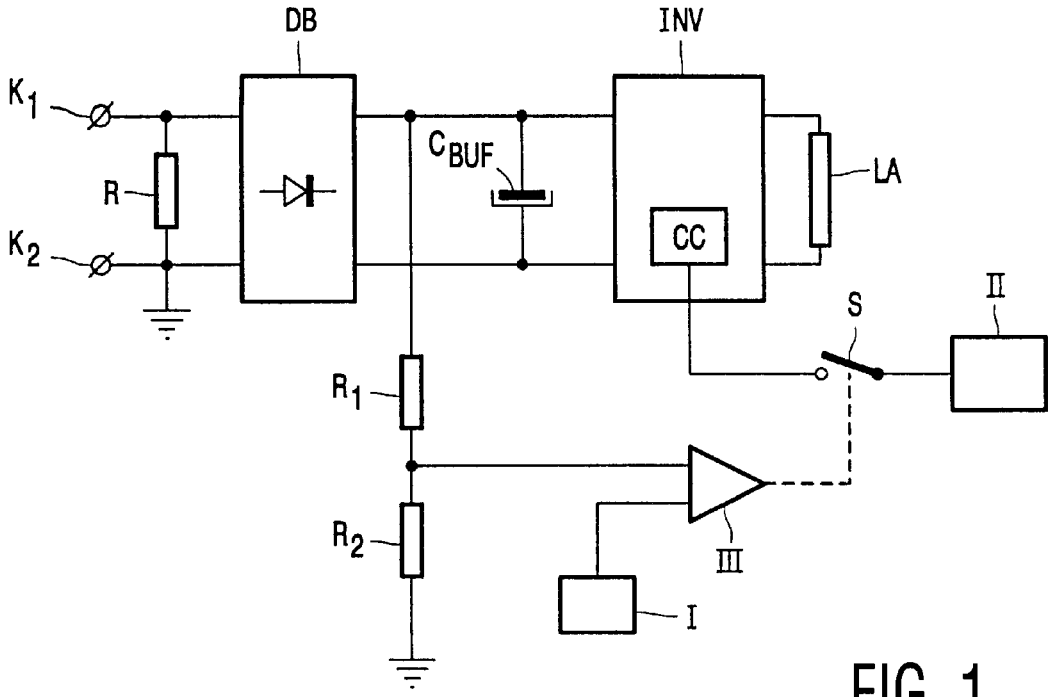

In FIG. 1, K1 and K2 are input terminals for connection to a supply voltage source. Input terminals K1 and K2 are connected to each other by means of an ohmic resistor R. Ohmic resistor R forms a circuit part that carries a current as long as the amplitude of the voltage supplied by the supply voltage source differs from zero. Input terminals K1 and K2 are also connected to respective input terminals of rectifier DB. Rectifier DB can be formed by a diode bridge or a voltage doubler. Output terminals of rectifier DB are connected by means of a capacitor Cbuf. Capacitor Cbuf forms in this embodiment buffer capacitor means. Respective sides of capacitor Cbuf are connected with respective input terminals of inverter INV for generating a high frequency lamp current out of a DC voltage that is present over the buffer capacitor means. The inverter comprises a control circuit CC for controlling the operation of the inverter INV. A discharge lamp La is connected to output terminals of the inverter INV. Resistors R1 and R2, reference voltage source I, comparator III, and switch S together form a shut off circuit for switching off the control circuit in case the DC voltage over the buffer capacitor means drops below a first predetermined value. Circuit part II is a supply circuit for generating a DC supply voltage for the control circuit CC. The control circuit successively controls the operation of the ballast circuit to preheat electrodes of the discharge lamp, to ignite the discharge lamp and to operate the discharge lamp.

Capacitor Cbuf is shunted by a series arrangement of resistors R1 and R2. A common terminal of resistors R1 and R2 is connected to a first input terminal of comparator III. A second input terminal of comparator III is connected to an output terminal of reference voltage source I. An output terminal of comparator III is coupled with switch S. This coupling is indicated in FIG. 1 by means of a dotted line. An output terminal of circuit part II is connected with an input terminal of control circuit CC via switch S.

The operation of the ballast circuit in FIG. 1 is as follows.

When the input terminals K1 and K2 are connected to the poles of a supply voltage source, the low frequency supply voltage supplied by the supply voltage source is rectified by the rectifier. As a result a DC voltage is present over capacitor Cbuf. The inverter INV generates a high frequency lamp current out of the DC voltage that flows through the lamp LA. Switch S is in a conducting state. The control circuit CC is supplied with a DC supply voltage that is generated by circuit part II. The ballast circuit is TRIAC dimmable and the low frequency supply voltage that is present between the input terminals is the output voltage of a TRIAC dimmer. The TRIAC dimmer is always carrying a current that flows through resistor R, even when the rest of the ballast circuit is not supplied with any current. As a result random firing of the TRIAC when the discharge lamp La has extinguished is prevented. When the phase angle of the TRIAC dimmer is higher than 90 degrees, the voltage over capacitor Cbuf decreases with increasing phase angle. A voltage that is representative for the DC voltage over Cbuf is the voltage that is present at the common terminal of resistors R1 and R2 and therefor also at the first input terminal of comparator III. Reference voltage source I generates a reference voltage that is present at the second input terminal of comparator III. For phase angles that are not too big, the voltage at the first input terminal of the comparator is higher than the reference voltage. As a consequence the voltage at the output of the comparator is high and switch S is maintained in a conducting state. In case, however, the phase angle is adjusted at a value that is too high, the DC voltage over capacitor Cbuf becomes so low that the voltage at the first input terminal of the comparator drops below the reference voltage. In that case the output voltage of the comparator becomes low and switch S is rendered non-conducting. Since the control circuit CC is no longer supplied with the DC supply voltage, the ballast circuit stops operating and the discharge lamp extinguishes. Once rendered non-conducting, switch S can only be rendered conducting again by the user, making use of circuit parts that are not shown in FIG. 1. In case the user decreases the phase angle to a value that allows stationary operation (i.e. a value that corresponds to a voltage at the first input terminal of the comparator that is higher than the reference voltage) and renders switch S conducting again the discharge lamp can once more be operated.

Figure 2:
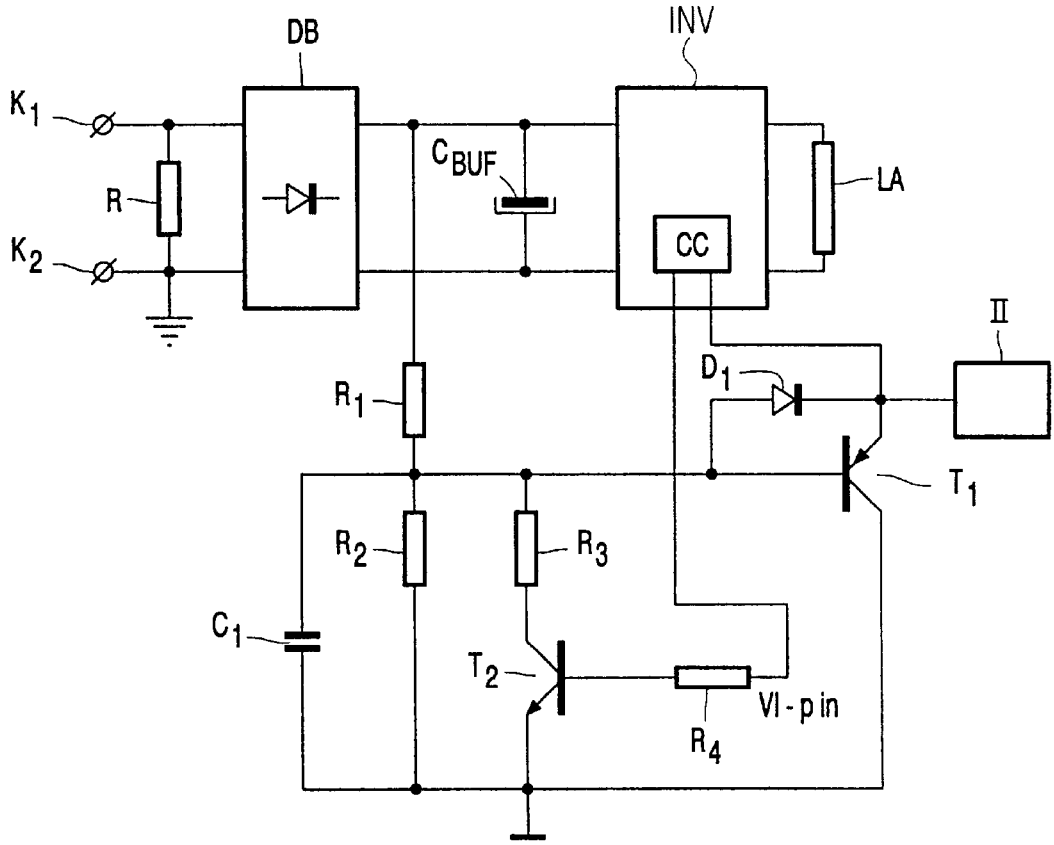

In FIG. 2 circuit parts and components that are similar to circuit parts and components in FIG. 1 are indicated by means of the same reference numerals.

K1 and K2 are input terminals for connection to a supply voltage source. Input terminals K1 and K2 are connected to each other by means of an ohmic resistor R. Ohmic resistor R forms a circuit part that carries a current as long as the amplitude of the voltage supplied by the supply voltage source differs from zero. Input terminals K1 and K2 are also connected to respective input terminals of rectifier DB. Rectifier DB can be formed by a diode bridge or a voltage doubler. Output terminals of rectifier DB are connected by means of a capacitor Cbuf. Capacitor Cbuf forms in this embodiment buffer capacitor means. Respective sides of capacitor Cbuf are connected with respective input terminals of inverter INV for generating a high frequency lamp current out of a DC voltage that is present over the buffer capacitor means. The inverter comprises a control circuit CC for controlling the operation of the inverter INV. A discharge lamp La is connected to output terminals of the inverter INV. Capacitor Cbuf is shunted by means of a series arrangement of resistor R1 and resistor R2. Resistor R2 is shunted by capacitor C1 and also by a series arrangement of resistor R3 and transistor T2. A base electrode of transistor T2 is connected to an output terminal of control circuit CC by means of resistor R4. Circuit part II is a circuit part for supplying a DC supply voltage to the control circuit CC. An output terminal of circuit part II is therefor connected to an input terminal of control circuit CC. The output terminal of circuit part II is also connected to an emitter electrode of pnp bipolar transistor T1. A base electrode of pnp bipolar transistor T1 is connected to a common terminal of resistor R2 and resistor R3. This common terminal of resistor R2 and resistor R3 is also connected to the output terminal of circuit part II by means of a diode D1. A collector electrode of pnp bipolar transistor T1 is connected to an emitter electrode of transistor T2. In this embodiment resistors R1–R4, capacitor C1, transistors T1 and T2 and diode D1 together form a shut off circuit for switching off the control circuit in case the DC voltage over the buffer capacitor means drops below a first predetermined value. Resistors R3 and R4, transistor T2 and the output terminal of control circuit CC together form a hysteresis circuit for after the first shut off of the control circuit reactivating the control circuit in case the DC voltage over the buffer capacitor means rises above a second predetermined value that is higher than the first predetermined value and switching off the control circuit when the DC voltage over the buffer capacitor means drops below the second predetermined value.

The control circuit CC successively controls the operation of the ballast circuit to preheat electrodes of the discharge lamp, to ignite the discharge lamp and to operate the discharge lamp. The voltage at the output terminal of the control circuit CC is high when the electrodes of the discharge lamp are preheated. During ignition and stationary operation of the discharge lamp the voltage at the output terminal is low. In this way the output terminal forms a deactivation circuit for deactivating the hysteresis circuit after the preheating of the electrodes of the discharge lamp. Capacitor C1 functions as a delay circuit for delaying the reactivation of the control circuit after the DC voltage over the buffer capacitor means has reached the second predetermined value.

The control circuit CC comprises a switch off circuit part for switching off the control circuit in case the DC supply voltage drops below a predetermined lock out voltage. Transistor T1 forms means for clamping the DC supply voltage to a fraction of the DC voltage that is present over the buffer capacitor means. This fraction is the voltage over resistor R2. Resistors R3 and R4, transistor T2 and the output terminal of control circuit CC together not only form a hysteresis circuit but also form a fraction decrease circuit for after shut off of the control circuit decreasing the fraction of the DC voltage over the buffer capacitor means that the DC supply voltage is clamped to.

The operation of the ballast circuit shown in FIG. 2 is as follows.

When the input terminals K1 and K2 are connected to the poles of a supply voltage source, the low frequency supply voltage supplied by the supply voltage source is rectified by the rectifier. As a result a DC voltage is present over capacitor Cbuf. During normal or dimmed lamp operation the inverter INV generates a high frequency lamp current out of the DC voltage that is present over capacitor Cbuf. Transistor T2 is not conducting during normal or dimmed lamp operation since the voltage at the output terminal of control circuit CC is low. The control circuit CC is supplied with a DC supply voltage that is generated by circuit part II. The ballast circuit is TRIAC dimmable and the low frequency supply voltage that is present between the input terminals is the output voltage of a TRIAC dimmer. When the phase angle of the TRIAC dimmer is higher than 90 degrees, the voltage over capacitor Cbuf decreases with increasing phase angle. A voltage that is representative for the DC voltage over Cbuf is the voltage that is present at the common terminal of resistors R1 and R2 and therefor also at the base electrode of transistor T1. In case the phase angle of the TRIAC dimmer is relatively low, the DC voltage over the capacitor Cbuf is relatively high. For this reason the voltage at the base electrode of transistor T1 is also relatively high and transistor T1 is not conducting. When the phase angle of the TRIAC dimmer is increased the DC voltage over Cbuf decreases and the voltage at the base electrode of transistor T1 decreases correspondingly. When the voltage at the base electrode of transistor T1 has dropped approximately 0.7 Volt below the DC supply voltage generated by circuit part II, transistor T1 becomes conducting. A further increase of the phase angle of the TRIAC dimmer results in a further decrease of the DC voltage over capacitor Cbuf and in a corresponding decrease in the voltage at the base electrode of transistor T1. Since transistor T1 is conducting the further increase in the phase angle of the TRIAC dimmer also results in a decrease in the voltage at the output terminal of circuit part II. In this way the DC supply voltage is effectively clamped to the fraction of the DC voltage over capacitor Cbuf that is formed by the voltage over resistor R2. In case the phase angle of the TRIAC dimmer is increased to such a high value that the DC supply voltage drops below the predetermined lock out voltage, the switch off circuit part comprised in the control circuit CC switches off the control circuit CC. The lamp extinguishes as a result. The first predetermined value at which switch off occurs is determined by the predetermined lock out voltage of the switch off circuit part and by resistors R1 and R2. In this way lamp flicker and electrode damage resulting from high phase angles are prevented. After the switching off of the control circuit CC the power consumption of the ballast circuit is drastically reduced. As a result of that the DC voltage over the capacitor increases and correspondingly the DC supply voltage also increases, so that the control circuit CC is switched on again. Immediately after the control circuit has been switched on again it controls the operation of the ballast circuit to preheat the electrodes. During the preheating of the electrodes the voltage at the output terminal of the control circuit CC is high so that transistor T2 is rendered conducting. When transistor T2 is conducting resistor R3 is in parallel with resistor R2. Since the resistance of the parallel arrangement of resistor R2 and resistor R3 is lower than the resistance of resistor R2, the fraction of the DC voltage over capacitor Cbuf that is present at the base electrode of transistor T1 and clamps the DC supply voltage is decreased. As a result the control circuit will be switched off in case the DC voltage over capacitor Cbuf drops below a second predetermined value that is higher than the first predetermined value and that is determined by resistors R1, R2 and R3 and by the lock out voltage of the switch off circuit part. The second predetermined value is chosen so that during the preheating of the electrodes the voltage over capacitor Cbuf drops below the second predetermined value in case the phase angle of the TRIAC dimmer is still too high. After the control circuit has been switched off, the ballast circuit no longer provides a preheat current to the electrodes of the discharge lamp. This causes the DC voltage over capacitor Cbuf to increase above the second predetermined value so that the control circuit is once more switched on and the ballast circuit once more provides a preheat current to the electrodes of the discharge lamp. During this preheating the DC voltage over capacitor Cbuf then drops again below the second predetermined value so that the control circuit is switched off. This process of switching the control circuit CC on and off and preheating while the control circuit is in the "on-state" is repeated as long as the phase angle of the TRIAC dimmer remains too high. The capacitor C1 causes the voltage increase at the base electrode of transistor T1 to be delayed with respect to the increase of the DC voltage over the capacitor Cbuf. As a result the "off-time" is increased, so that the electrodes can cool down longer between the time intervals during which the electrodes are preheated, so that a lower average electrode temperature results and damage to the electrodes is prevented. In case a user of the ballast decreases the phase angle of the TRIAC dimmer to a value that allows stable lamp operation, the DC voltage over the capacitor Cbuf is increased. As a result the control circuit is not switched off during the preheating of the electrodes, so that the discharge lamp is ignited. Immediately after the preheating of the electrodes the voltage at the output terminal of the control circuit becomes low so that transistor T2 becomes non-conducting and resistor R3 is no longer in parallel with resistor R2. As a consequence the control circuit is only switched off in case the DC voltage over the capacitor Cbuf drops below the first predetermined value.

Figure 3:
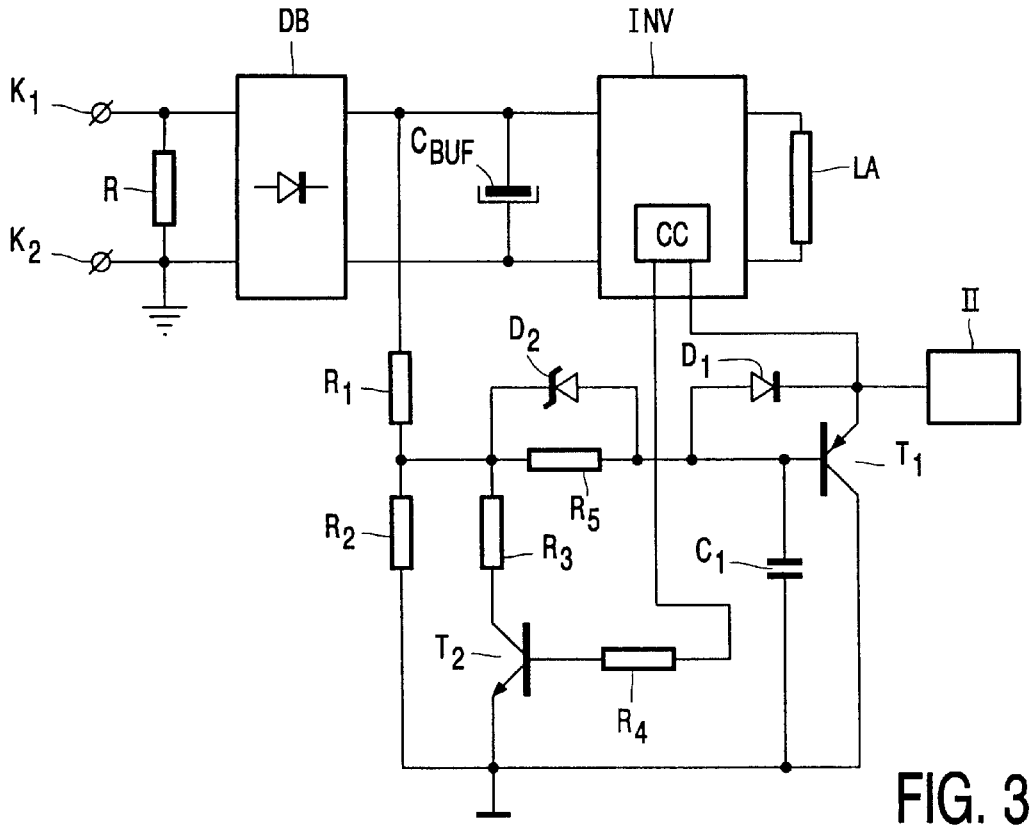

The embodiment of a ballast circuit according to the invention shown in FIG. 3 only differs from the embodiment in FIG. 2 in that the capacitor C1 is connected between the base electrode and the collector electrode of transistor T1 and in that the common terminal of resistor R2 and resistor R3 is connected to a common terminal of diode D1 and the base electrode of transistor T1 by means of a parallel arrangement of resistor R5 and zener diode Dz. In this embodiment resistor R5, zener diode Dz and capacitor C1 together form a delay circuit circuit for delaying the reactivation of the control circuit after the DC voltage over the buffer capacitor means has reached the second predetermined value. These delay means do so by delaying the increase of the voltage at the base electrode of transistor T1 with respect to the increase of the DC voltage over the capacitor Cbuf. As a result, in case of a phase angle that is too high, the control circuit remains switched off longer between two time intervals during which the electrodes are heated resulting in a lower average electrode temperature preventing damage to the electrodes. The switching off of the control circuit is not delayed since zener diode Dz shunts resistor R5 and has a low impedance. The "off time" can be increased by increasing the capacity of capacitor C1. When the ballast circuit is first switched on capacitor C1 can be charged quickly despite its large capacity because the charging takes place not only via resistor R5 but also via zener diode Dz. In all other respects the operation of the embodiment shown in FIG. 3 is very similar to the operation of the embodiment shown in FIG. 2 and will therefor not be described separately.

Figure 4:
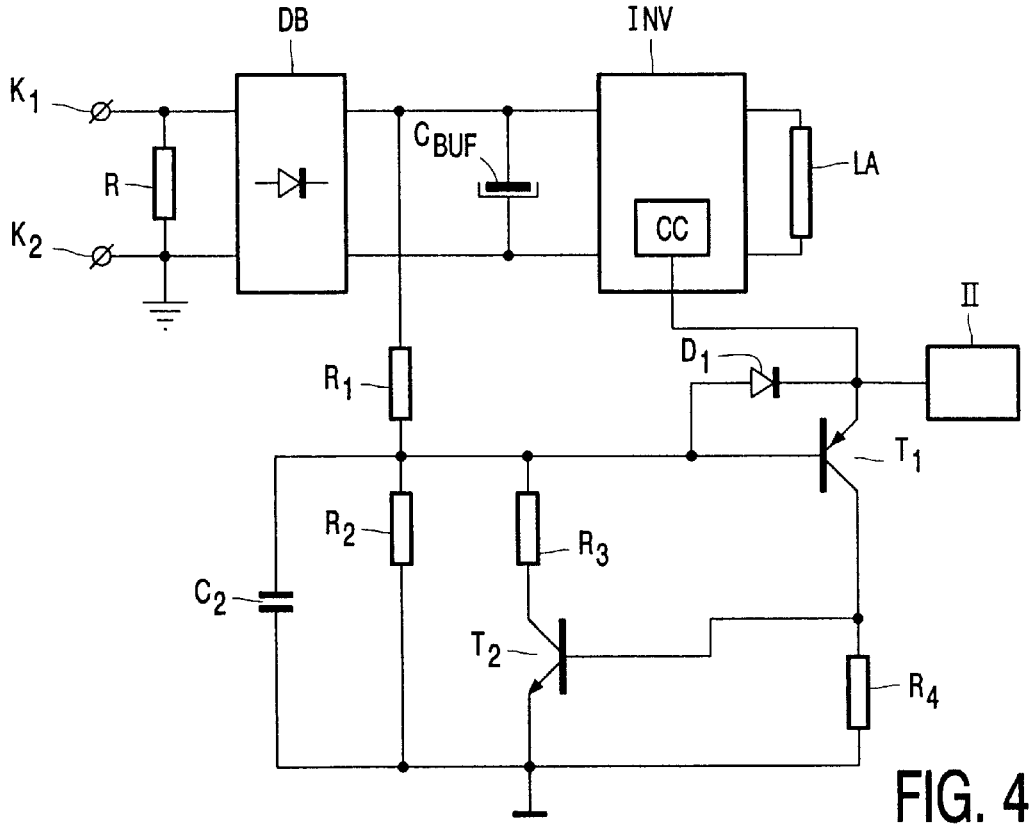

The embodiment shown in FIG. 4 differs from the embodiment shown in FIG. 2 in that the base electrode of transistor T2 is not connected to the output terminal of the control circuit CC by means of resistor R4 but connected to the emitter electrode of transistor T2 by means of resistor R4. A common terminal of resistor R4 and the base electrode of transistor T2 is connected to the collector electrode of transistor T1. Transistor T2 is rendered conducting as soon as transistor T1 conducts, because when transistor T1 conducts the voltage over resistor R4 is present over the base-emitter junction of transistor T2. An important advantage of the embodiment shown in FIG. 4 is that no output signal of control circuit is needed to control the conductive state of transistor T2. In the embodiment shown in FIG. 4, transistor T2 is not automatically rendered non-conducting when the preheating of the electrodes ends. In case the DC voltage over capacitor Cbuf drops below the second predetermined value during ignition or dimmed operation, the control circuit is switched off. Since the second predetermined value is higher than the first predetermined value this can be a disadvantage in case the amount of power consumed by the ballast circuit during ignition or dimmed operation differs substantially from the amount of power consumed during preheating of the electrodes. In all other respects the operation of the embodiment shown in FIG. 4 is very similar to the operation of the embodiment shown in FIG. 2 and will therefor not be described separately.

It is remarked that the present invention can be used in ballast circuits that are TRIAC dimmable by means of a dimming circuit and a conversion circuit such as comprised in the ballast circuit disclosed in WO 98/46054. The present invention can, however, equally well be implemented for instance in ballast circuits that do not comprise a dimming circuit or a conversion circuit, but are TRIAC dimmable because the DC voltage over the buffer capacitor means is decreased by increasing the phase angle for phase angle values higher than 90 degrees. The decrease of the DC voltage over the buffer capacitor causes a lower light output of the discharge lamp.

What is claimed is:

1. A ballast circuit for operating a discharge lamp comprising:

input terminals for connection to an adjustable dimmer providing a low frequency supply voltage, rectifier coupled to the input terminals for rectifying the low frequency supply voltage, buffer capacitor means coupled to an output of the rectifier, for charging to a DC voltage, said voltage being dependent on the adjustment of the dimmer, and an inverter coupled to the buffer capacitor means for generating a high frequency lamp current from the DC voltage during operation, said inverter comprising a control circuit for controlling operation of the inverter, the ballast circuit further comprising a shut off circuit for switching off the control circuit and the lamp if said DC voltage drops below a first predetermined value, said first predetermined value being greater than a value at which the control circuit will receive insufficient energy to operate properly.

2. A ballast circuit according to claim 1, characterized in that the input terminals are connected by means of a circuit part that carries a current so long as the low frequency supply voltage has an amplitude that differs from zero, whereby current through said circuit part assures stable TRIAC operation.

3. A ballast circuit according to claim 2, characterized in that the circuit part comprises an ohmic resistor.

4. A ballast circuit according to claim 1, characterized in the ballast circuit further comprises a supply circuit part coupled to the control circuit for generating a DC supply voltage for the control circuit, the control circuit comprises a switch off circuit part for switching off the control circuit if the DC supply voltage drops below a predetermined lock out voltage, and the shut off circuit comprises means for clamping the DC supply voltage to a fraction of said DC voltage present on the buffer capacitor means.

5. A ballast circuit according to claim 4, characterized in that said means for clamping comprises a bipolar transistor.

6. A ballast circuit according to claim 5, characterized in that the shut off circuit comprises a fraction decrease circuit responsive to shut off of the control circuit, for decreasing said fraction of said DC voltage.

7. A ballast circuit according to claim 6, characterized in that said fraction decrease circuit comprises a transistor.

8. A compact fluorescent lamp including a ballast circuit comprising:

input terminals for connection to a low frequency supply voltage source, a rectifier coupled to the input terminals for rectifying the low frequency supply voltage supplied by the supply voltage source, buffer capacitor means coupled to an output of the rectifier, having a DC voltage present thereon during operation, and an inverter coupled to the buffer capacitor means for generating a high frequency lamp current from the DC voltage during operation, said inverter comprising a control circuit for controlling operation of the inverter, characterized in that the ballast circuit further comprises a shut off circuit for switching off the control circuit if said DC voltage drops below a first predetermined value, said first predetermined value being greater than a value at which the control circuit will receive insufficient energy to operate properly.

9. A ballast circuit for operating a discharge lamp comprising:

input terminals for connection to a low frequency supply voltage source, a rectifier coupled to the input terminals for rectifying the low frequency supply voltage supplied by the supply voltage source, buffer capacitor means coupled to an output of the rectifier, having a DC voltage present thereon during operation, and an inverter coupled to the buffer capacitor means for generating a high frequency lamp current from the DC voltage during operation, said inverter comprising a control circuit for controlling operation of the inverter, characterized in that the ballast circuit further comprises a shut off circuit for switching off the control circuit if said DC voltage drops below a first predetermined value, said shut off circuit comprising a hysteresis circuit responsive to first shut off of the control circuit, for reactivating the control circuit if said DC voltage rises above a second predetermined value higher than the first predetermined value and for switching off the control circuit if said DC voltage drops below the second predetermined value.

10. A ballast circuit according to claim 9, characterized in that the control circuit successively controls the operation of the ballast circuit to preheat electrodes of the discharge lamp and to ignite the discharge lamp, and the shut off circuit comprises a deactivation circuit for deactivating the hysteresis circuit after the preheating of the electrodes of the discharge lamp.

11. A ballast circuit according to claim 9, characterized in that the input terminals are connected by means of a circuit part that carries a current so long as the low frequency supply voltage has an amplitude that differs from zero, whereby current through said circuit part assures stable TRIAC operation.

12. A ballast circuit according to claim 11, characterized in that the circuit part comprises an ohmic resistor.

13. A ballast circuit according to claim 9, characterized in that the shut off circuit comprises a delay circuit for delaying the reactivation of the control circuit after said DC voltage has reached the second predetermined value.

14. A ballast circuit according to claim 13, characterized in that the delay circuit further comprises a resistor and a capacitor, and the resistor is shunted by an element chosen from the group formed by a diode and a zener diode.

15. A ballast circuit according to claim 9, characterized in that:

the ballast circuit further comprises a supply circuit part coupled to the control circuit for generating a DC supply voltage for the control circuit, the control circuit comprises a switch off circuit part for switching off the control circuit if the DC supply voltage drops below a predetermined lock out voltage, and the shut off circuit comprises means for clamping the DC supply voltage to a fraction of said DC voltage present on the buffer capacitor means.

16. A ballast circuit according to claim 15, characterized in that said means for clamping comprises a bipolar transistor.

17. A ballast circuit according to claim 16, characterized in that the shut off circuit comprises a fraction decrease circuit responsive to shut off of the control circuit, for decreasing said fraction of said DC voltage, to which said DC supply voltage is clamped.

18. A ballast circuit according to claim 16, characterized in that said fraction decrease circuit comprises a transistor.

* * * * *